US007422472B2

(12) United States Patent
Hashiguchi et al.

(10) Patent No.: US 7,422,472 B2
(45) Date of Patent: Sep. 9, 2008

(54) CONNECTOR

(75) Inventors: Osamu Hashiguchi, Tokyo (JP); Kanji Inoue, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/893,742

(22) Filed: Aug. 16, 2007

(65) Prior Publication Data

US 2008/0050958 A1 Feb. 28, 2008

(30) Foreign Application Priority Data

Aug. 23, 2006 (JP) ..... 2006-226756

(51) Int. Cl.
*H01R 12/24* (2006.01)

(52) U.S. Cl. ..... 439/495; 439/260; 439/607; 439/630

(58) Field of Classification Search ..... 439/495, 439/260, 607, 609, 939, 946, 630, 941
See application file for complete search history.

(56) References Cited

U.S. PATENT DOCUMENTS 6,068,516 A * 5/2000 Chang ..... 439/633
6,752,663 B2 * 6/2004 Bright et al. ..... 439/607
6,855,002 B2 * 2/2005 Chiu ..... 439/495
6,872,094 B1 * 3/2005 Murr et al. ..... 439/607
7,044,773 B2 * 5/2006 Suzuki et al. ..... 439/495
7,147,498 B1 * 12/2006 Gillespie et al. ..... 439/260
7,214,099 B2 * 5/2007 Kikuchi et al. ..... 439/630
7,258,561 B2 * 8/2007 Fukazawa ..... 439/260
7,311,542 B2 * 12/2007 Suzuki ..... 439/260

FOREIGN PATENT DOCUMENTS

JP 8-180940 A 7/1996

* cited by examiner

*Primary Examiner*—Michael C Zarroli
(74) *Attorney, Agent, or Firm*—Frishauf, Holtz, Goodman & Chick, P.C.

(57) ABSTRACT

To provide a connector that includes a locking section having a high strength, and is excellent in shielding performance. Contacts are held by a housing including a receiving space into which is inserted FPC. An actuator is mounted in the housing in a manner pivotally movable between open position for inserting FPC into the space, and closed position for holding FPC therein. The housing is covered with a shield plate. The shield plate includes a contact portion for contact with a ground line of FPC, a terminal portion for contact with a printed circuit board, and a seesaw-type locking section for preventing FPC from being removed. A nail portion is formed at one end of the locking section, for engagement with FPC, and a power point portion on which a pivotal force of the actuator acts is formed at the other end. The actuator is provided with a third cam portion which is operable when the actuator is in closed position, to move the power point portion such that the nail portion comes closer to FPC.

4 Claims, 4 Drawing Sheets

CONNECTOR

BACKGROUND OF THE INVENTION

1. Field of the Invention

This invention relates to a connector, and more particularly to a connector suitable for electrically connecting between an FPC (Flexible Printed Circuit) and a printed wiring board.

2. Prior Art

Conventionally, there has been proposed a connector comprising a plurality of contacts, a housing that holds the contacts, and an actuator that is rotatably mounted on the housing and elastically deforms the contacts to thereby bring the contacts into contact with an FPC.

When the actuator is operated for rotation, the connecting portion of the contact is urged against the FPC to generate a contact force between the FPC and the connecting portion of the contact. If a force in the removing direction acts on the FPC in this state due to some cause, the FPC sometimes drops off the connector.

The conventional technique for eliminating this inconvenience includes provision of a locking section formed with a nail for prevention of removal of the FPC.

However, this conventional technique suffers from the problem that the locking section is formed of a synthetic resin and hence low in strength, and the strength for preventing the removal of the FPC is also low.

Further, no shell is provided for connection to the ground of the FPC, and hence it is impossible to ground the connector (see Japanese Laid-Open Patent Publication (Kokai) No. H08-180940).

The above-described connector also suffers from the problem of low shielding performance.

SUMMARY OF THE INVENTION

The present invention has been made in view of these circumstances, and an object thereof is to provide a connector that includes a locking section having a high strength, and is excellent in shielding performance.

To attain the above object, the present invention provides a connector for electrically connecting a pair of connected objects, comprising a housing having a receiving space into which one connected object of the pair of connected objects is inserted, a plurality of contacts held in the housing, an actuator mounted in the housing in a manner pivotally movable between an open position for allowing insertion of the connected object into the receiving space and a closed position for holding the connected object in the receiving space, and a metallic shell covering the housing, the shell including a contact portion capable of being brought into contact with a ground line of the one connected object, a terminal portion capable of being brought into contact with a connection terminal portion of the other connected object of the pair of connected objects, and a seesaw-type locking section for preventing the one connected object from being removed, the seesaw-type locking section having a nail portion at one end thereof, for engagement with the one connected object, and a power point portion at the other end thereof, on which a pivotal force of the actuator acts, wherein the actuator includes a cam portion that is operable when the actuator is in the closed position, to push upward the power point portion, to thereby move the nail portion such that the nail potion comes closer to the other connected object.

With the arrangement of the connector according to the present invention, the seesaw-type locking section for preventing the one connected object from being removed is provided in the shell, and hence the locking section has an increased strength and is excellent in the shielding performance. Further, the actuator moves the contact portion of the shell toward the one connected object, which positively brings the contact portion into contact with the ground. In other words, it is possible to obtain a sufficient contact force, which improves the connecting performance of the connector.

Preferably, the nail portion of the locking section also functions as the contact portion.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
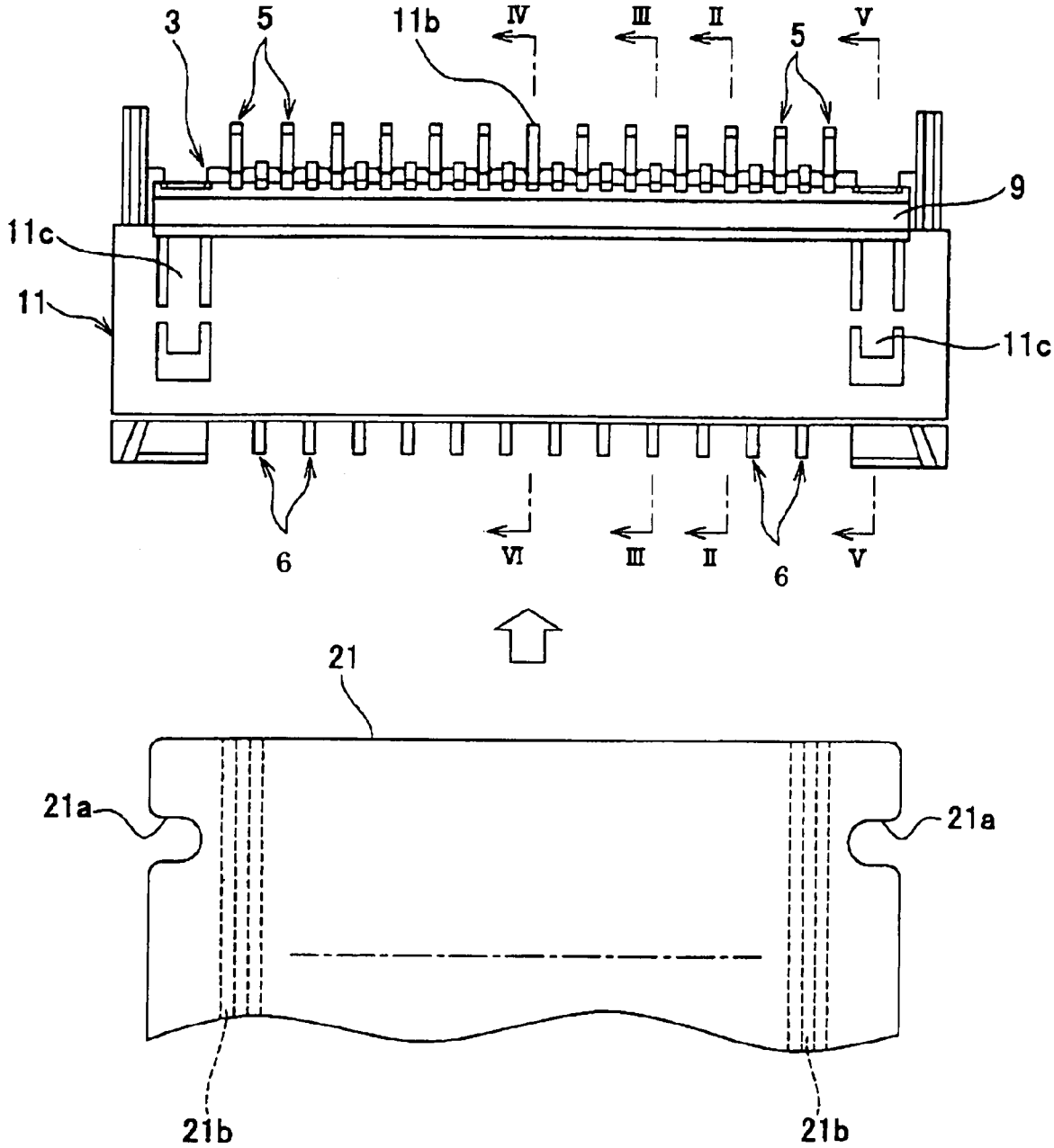
FIG. 1 is a plan view of a connector according to a first embodiment of the present invention.

Referring to FIG. 1, the connector is for an FPC (one connected object), and is comprised of a housing 3, the first contacts 5, the second contacts 6, the actuator 9, and a shield plate 11. The connector is mounted on a printed wiring board (the other connected object), not shown.

Figure 2:
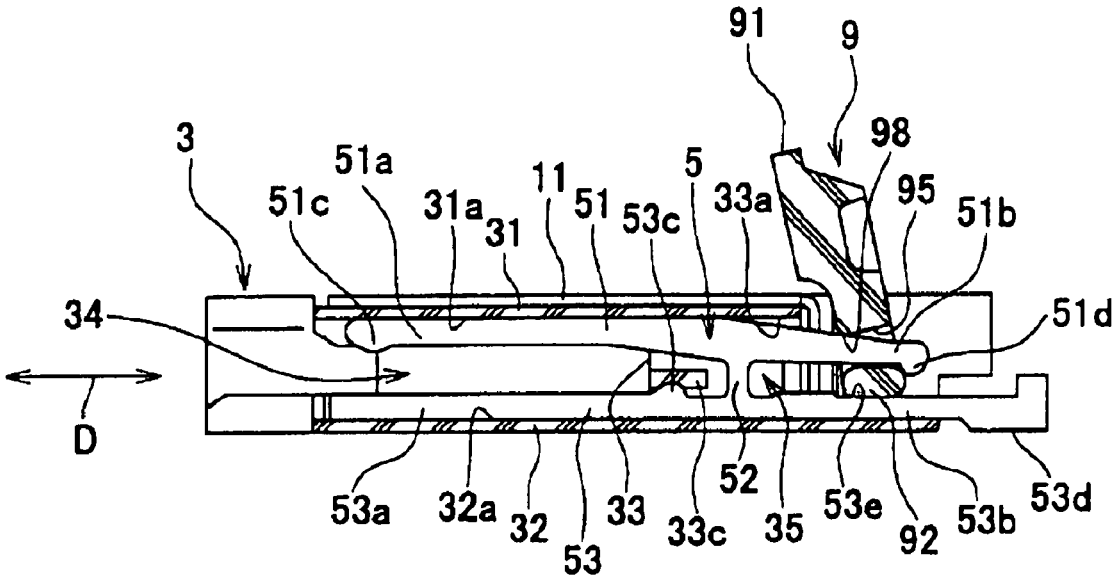
FIG. 2 is a cross-sectional view taken on line II-II of FIG. 1.
Figure 3:
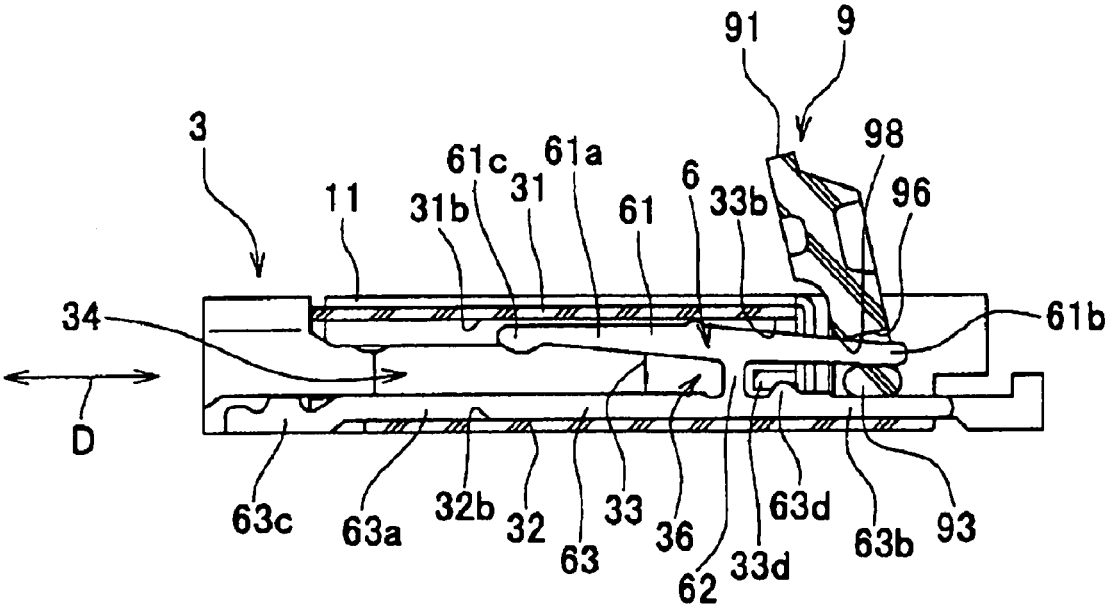
FIG. 3 is a cross-sectional view taken on line III-III of FIG. 1.

As shown in FIGS. 2 and 3, the housing 3 includes a ceiling 31, a bottom 32, and a connecting portion 33. Formed between the ceiling 31 and the bottom 32 is an FPC-receiving space (receiving space) 34.

The ceiling 31 has accommodation grooves 31*a* and accommodation grooves 31*b* formed in a lower surface thereof such that they are arranged alternately in the longitudinal direction of the housing 3.

The bottom 32 has accommodation grooves 32*a* and accommodation grooves 32*b* formed in an upper surface thereof such that they are arranged alternately in the longitudinal direction of the housing 3.

The connecting portion 33 connects the ceiling 31 and the bottom 32. The connecting portion 33 has accommodation holes 33*a* and accommodation holes 33*b* formed therein such that they are arranged alternately in the longitudinal direction of the housing 3. Each accommodation hole 33*a* extends along the direction of insertion of the FPC 21 and communicates with associated ones of the accommodation grooves 31*a* and 32*a*. Each accommodation hole 33*b* extends along the direction D of insertion of the FPC, and communicates with associated ones of the accommodation grooves 31*b* and 32*b*. The accommodation hole 33*a* has a press contact piece 33*c* formed therein. The accommodation hole 33*b* has a press contact piece 33*d* formed therein.

The above-described accommodation grooves 31*a* and 32*a* and accommodation holes 33*a* form a first contact-accommodating space 35. The above-described accommodation grooves 31*b* and 32*b* and accommodation holes 33*b* form a second contact-accommodating space 36.

Each first contact 5 includes a first beam 51, a spring piece 52, and a second beam 53. The first beam 51 is connected to the second beam 53 via the spring piece 52 such that it can perform a seesaw operation. The first beam 51 and the second beam 53 are substantially parallel to each other. The first beam 51 has a portion toward one end thereof (portion on the left side of the spring piece 52 as viewed in FIG. 2) formed as a contact portion 51*a*, and a portion toward the other end thereof (portion on the right side of the spring piece 52 as viewed in FIG. 2) formed as a power point portion 51*b*. The contact portion 51*a* is formed with a contact point 51*c*. The power point portion 51*b* has a rear end thereof formed with an engaging portion 51*d*.

The second beam 53 has a portion toward one end thereof (portion on the left side of the spring piece 52 as viewed in FIG. 2) formed as a first beam portion 53*a*, and a portion toward the other end thereof (portion on the right side of the spring piece 52 as viewed in FIG. 2) formed as a second beam portion 53*b*. The first beam portion 53*a* is formed with a press-fitted piece 53*c*. The press-fitted piece 53*c* is press-fitted into the press contact piece 33*c*, whereby the first contact 5 is held in a state fixed within the first contact-accommodating space 35. The second beam portion 53*b* is formed with a terminal portion 53*d*. The terminal portion 53*d* is soldered to the printed wiring board, not shown. Further, the second beam portion 53*b* is formed with a recess 53*e*.

Each second contact 6 includes a first beam 61, a spring piece 62, and a second beam 63. The first beam 61 is connected to the second beam 63 via the spring piece 62 such that it can perform a seesaw operation. The first beam 61 is slightly inclined with respect to the second beam 63. The first beam 61 has a portion toward one end thereof (portion on the left side of the spring piece 62 as viewed in FIG. 3) formed as a contact portion 61*a*, and a portion toward the other end thereof (portion on the right side of the spring piece 62 as viewed in FIG. 3) formed as a power point portion 61*b*. The contact portion 61*a* is formed with a contact point 61*c*.

The second beam 63 has a portion toward one end thereof (portion on the left side of the spring piece 62 as viewed in FIG. 3) formed as a first beam portion 63*a*, and a portion toward the other end thereof (portion on the right side of the spring piece 62 as viewed in FIG. 2) formed as a second beam portion 63*b*. The first beam portion 63*a* has a foremost end thereof formed with a terminal portion 63*c*. The terminal portion 63*c* is soldered to the printed wiring board, not shown. The second beam portion 63*b* is formed with a press-fitted piece 63*d*. The press-fitted piece 63*d* is press-fitted into the press contact piece 33*d*, whereby the second contact 6 is held in a state fixed within the second contact-accommodating space 36.

The actuator 9 has one end in the direction of the width thereof formed with an operating section 91, and the other end in the direction of the width thereof formed with first cam portions 92, second cam portions (cam portions) 93, and third cam portions 94. The first cam portions 92, the second cam portions 93, and the third cam portions 94 each have a substantially elliptical shape in cross section. Although in the present embodiment, the sizes thereof are different from each other, they may have the same size.

The operating section 91 has a substantially convex shape. The actuator 9 is operated by putting a finger on the operating section 91.

The first cam portions 92 and the second cam portions 93 are in an alternate arrangement.

Each first cam portion 92 is sandwiched by the power point portion 51*b* and the second beam portion 53*b* of an associated one of the first contacts 5, and is further engaged with the engaging portion 51*d* and the recess 53*e* such that the first cam portion 92 is prevented from dropping off the associated first contact 5. Each second cam portion 93 is sandwiched by the power point portion 61*b* and the second beam portion 63*b* of an associated one of the second contacts 6. Therefore, the actuator 9 is pivotally held by the first contacts 5 and the second contacts 6.

The actuator 9 has through holes 95 formed therethrough at respective location adjacent to the first cam portions 92. Each through hole 95 has an associated one of the power point portions 51*b* inserted therethrough.

The actuator 9 has through holes 96 formed therethrough at respective locations adjacent to the second cam portions 93. Each through hole 96 has an associated one of the power point portions 61*b* extended therethrough.

The third cam portions 94 are formed at opposite ends of the actuator 9 in the longitudinal direction thereof.

Figure 4:
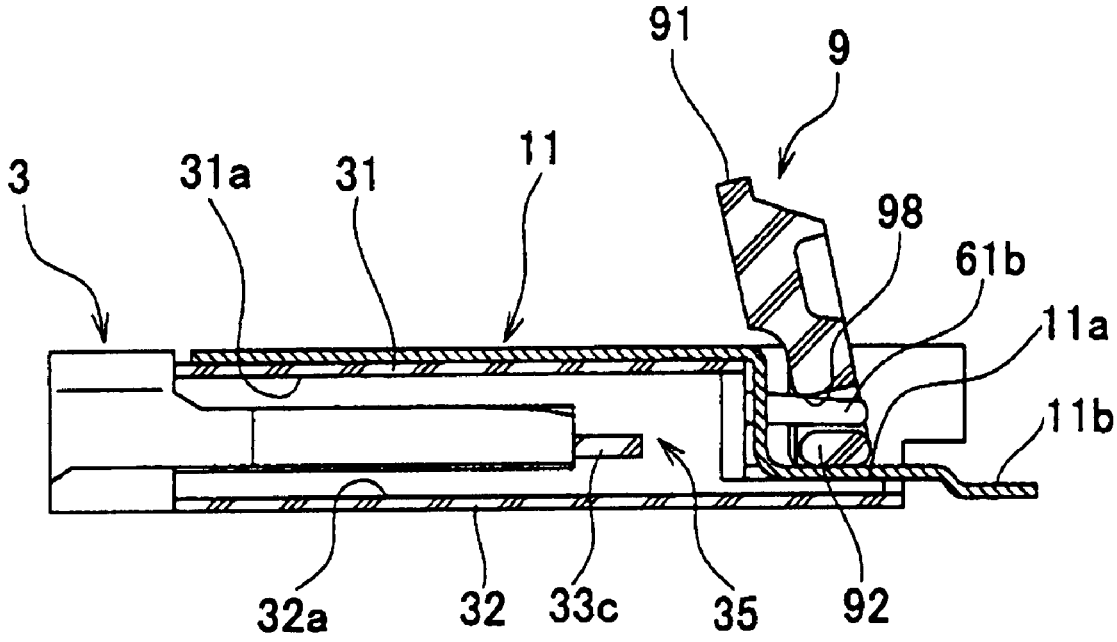
FIG. 4 is a cross-sectional view taken on line V-V of FIG. 1.

The shield plate 11 covers the ceiling 31. As the material of the shield plate 11, there may be mentioned stainless steel, copper, etc. As shown in FIG. 4, the shield plate 11 has a rear end of a longitudinal central portion thereof formed with an extended portion 11*a* covering the connecting portion 33 of the housing 3 and a rear end of the bottom 32 of the same. The extended portion has a distal end formed with a terminal portion 11*b*. The terminal portion 11*b* is soldered to a ground line of the printed circuit board (not shown). One first contact-accommodating space 35 opposed to the extended portion 11*a* does not accommodate the first contact 6.

By forming the terminal portion 11*b* of the shield plate 11 and the terminal portion 53*d* of the first contact 5 such that they have substantially the same shape in plan view, it is possible to pattern the signal lines and the ground lines of the printed circuit board (not shown) such that they have the same shape.

The shield plate 11 has longitudinal opposite ends thereof formed with respective locking sections 11*c*. The locking section 11*c* performs a seesaw operation. The distal end of the locking section 11*c* is formed with a locking nail 11*d*. The locking nail 11*d* is inserted into a cutout 21*a* of the FPC 21 inserted into the FPC-receiving space 34. This locks the FPC 21. The locking section 11*c* has a power point portion 11*f* connected to a rear end thereof.

The shield plate 11 is formed with a contact portion 11*e* at a location adjacent to the locking nail lid. The contact portion 11*e* is brought into contact with the ground line 21*b* of the FPC 21.

Although the actuator 9 is pivotally held by the first contacts 5 and the second contacts 6, as described above, but it is pivotally movable between an open position (position of the actuator 9 in a state where it can receive the FPC 21: the state shown in FIGS. 2 and 3) and a closed position (position of the actuator 9 in a state where the first and second contacts are brought into contact with the FPC). Further, positions of contact between the first and second cam portions 92 and 93 and the respective power point portions 51*b* and 61*b* are displaced in the FPC inserting direction with respect to positions of contact between the first and second cam portions 92 and 93 and the respective second beam portions 53*b* and 63*b*, respectively. With this arrangement, when the actuator 9 is in a position close to the open position, a moment for pivotally moving the actuator 9 toward the open position is generated, whereas when the actuator 9 is in a position close to the closed position, a moment for pivotally moving the actuator 9 toward the closed position is generated.

When the actuator 9 is in the closed position, the first cam portion 92 pushes upward the power point portion 51*b* of the associated first contact 5, whereby the contact portion 51*a* of the associated first contact 5 is pushed downward such that the contact portion 51*a* enters the FPC-receiving space 34.

When the actuator 9 is in the closed position, the second cam portion 93 pushes upward the power point portion 61*b* of the associated second contact 6, whereby the contact portion 61*a* of the associated second contact 6 is pushed downward such that the contact portion 61*a* enters the FPC-receiving space 34.

When the actuator 9 is in the closed position, the third cam portion 94 pushes upward the associated power point portion 11*f* connected to the locking section 11*c* of the shield plate 11 whereby the nail portion 11*d* of the locking section 11*c* is pushed downward such that the nail portion 11*d* enters the cutout 21*a*. At this time, the associated contact portion 11*e* is also pushed downward, and hence is pressed against the ground of the FPC, whereby a sufficient contact force can be obtained to positively bring the contact portion 11*e* into contact with the ground of the FPC.

Peripheral edges of the through holes 95 and 96 toward the operating section 91 form pressing portions 98.

When the actuator 9 is in the open position (state shown in FIGS. 2 and 3), the pressing portions 98 push the power point portions 51*b* and 61*b* downward, to thereby move the contact portions 51*a* and 61*a* out of the FPC-receiving space 34.

Figure 5:
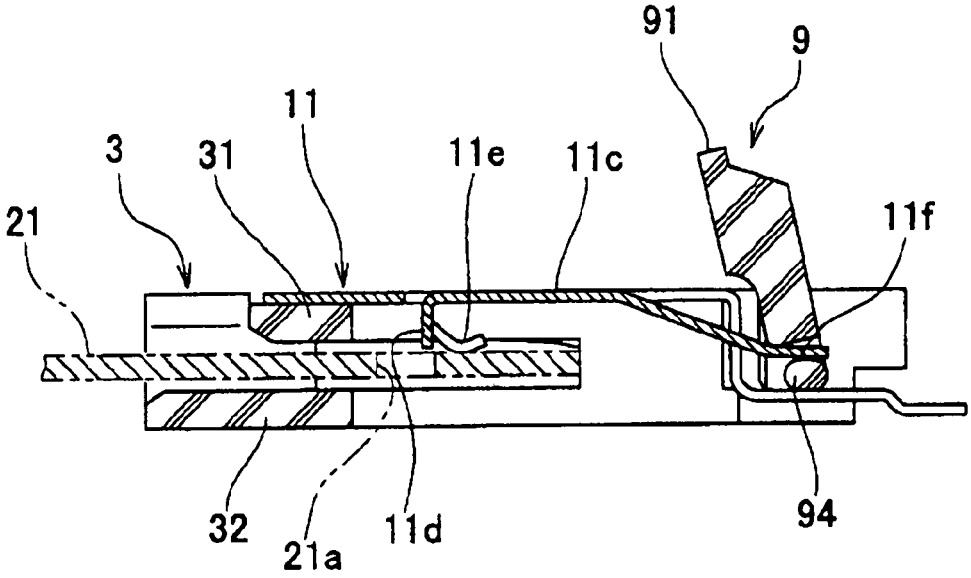
FIG. 5 is a cross-sectional view taken on line V-V of FIG. 1.
Figure 6:
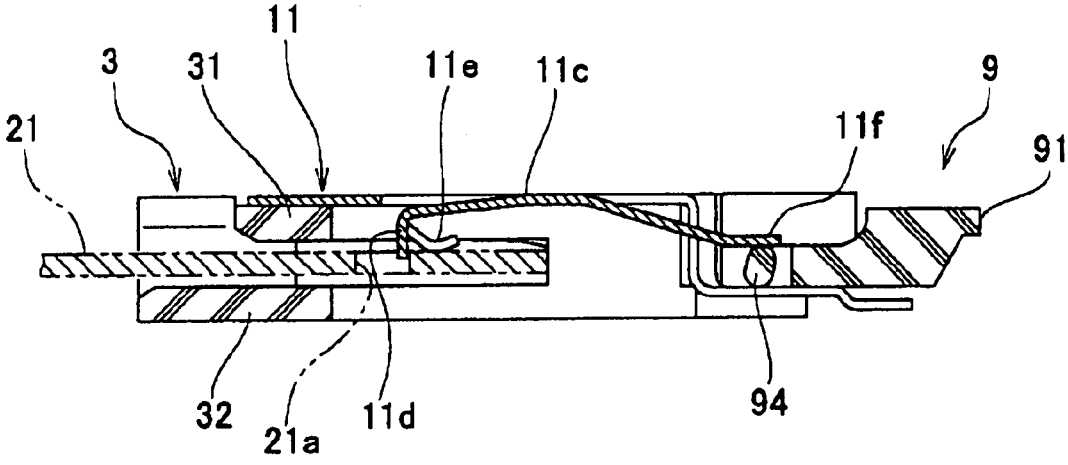
FIG. 6 is a cross-sectional view of the connector in a state in which the actuator is in a closed position, which is taken on line V-V of FIG. 1.

Further, when the actuator 9 is in the open position, the third cam portions 94 do not push the power point portions 11*f*, but the locking sections 11*c* return to their original state (shown in FIG. 5) by its own resilient force, whereby the nail portion 11*d* is moved out of the cutout 21*a* to release the locking of the FPC 9.

As described heretofore, according to the present embodiment, it is possible to facilitate insertion of the FPC, and obtain a sufficient contact force for being brought into contact with the ground of the FPC.

Also, it is possible to shield the connector by the shield plate 11.

Further, since the shield plate 11 is provided with the locking sections 11*c* for locking the FPC 21, and hence the locking sections 11*c* have a high strength, and are capable of positively locking the FPC 21.

It should be note that although in the above-described embodiments, the present invention is applied to the connector for an FPC, this is not limitative, but the present invention can also be applied to a connector e.g. for an FFC (Flexible Flat Cable).

It is further understood by those skilled in the art that the foregoing are the preferred embodiments of the present invention, and that various changes and modification may be made thereto without departing from the spirit and scope thereof.

The invention claimed is:

1. A connector for electrically connecting a pair of connected objects, comprising:

a housing having a receiving space into which one connected object of the pair of connected objects is inserted;

a plurality of contacts held in said housing;

an actuator mounted in said housing in a manner pivotally movable between an open position for allowing insertion of the connected object into the receiving space and a closed position for holding the connected object in the receiving space, and a metallic shell covering said housing, said shell including a contact portion capable of being brought into contact with a ground line of the one connected object, a terminal portion capable of being brought into contact with a connection terminal portion of the other connected object of the pair of connected objects, and a seesaw-type locking section for preventing the one connected object from being removed, said seesaw-type locking section having a nail portion at one end thereof, for engagement with the one connected object, and a power point portion at the other end thereof, on which a pivotal force of said actuator acts, wherein said actuator includes a cam portion that is operable when said actuator is in the closed position, to push upward the power point portion, to thereby move said nail portion such that said nail potion comes closer to the other connected object.

2. A connector as claimed in claim 1, wherein said nail portion of said locking section also functions as said contact portion.

3. A connector as claimed in claim 1, wherein said actuator includes a pressing portion that is operable when said actuator is in the open position, to push said power point portion downward, to thereby move said contact portion such that said contact portion out of said receiving space.

4. A connector as claimed in claim 2, wherein said actuator includes a pressing portion that is operable when said actuator is in the open position, to push said power point portion downward, to thereby move said contact portion such that said contact portion out of said receiving space.

* * * * *